166-275 SR
6/14/83 XR 4,387,767

United States Patent [19]
Read

[11] 4,387,767
[45] Jun. 14, 1983

[54] SUBSURFACE SAFETY VALVE SYSTEM WITH HYDRAULIC PACKER

[75] Inventor: Norman W. Read, Dallas, Tex.

[73] Assignee: Dresser Industries, Inc., Dallas, Tex.

[21] Appl. No.: 206,595

[22] Filed: Nov. 13, 1980

[51] Int. Cl.[3] ..... E21B 33/122
[52] U.S. Cl. ..... 166/72; 166/120; 166/212; 166/282; 166/275; 166/375
[58] Field of Search ..... 166/313, 120, 117.5, 166/72, 212, 382, 375

[56] References Cited

U.S. PATENT DOCUMENTS 3,299,959 1/1967 Brown ..... 166/120
3,412,806 11/1968 Fredd ..... 166/72
3,625,281 12/1971 Herd ..... 166/212
4,022,273 5/1977 Marathe ..... 166/65 R

*Primary Examiner*—William F. Pate, III
*Attorney, Agent, or Firm*—W. R. Peoples

[57] ABSTRACT

A well production apparatus for fluid production through a pair of downhole safety valves to both well tubing and the tubing annulus includes a packer with a dual bore head connected to the lower end of the tubing. Primary and secondary packer mandrels depending from connections with said head serve as conduits for directing production fluid to the safety valves with the secondary mandrel also serving as a conduit through which a power conductor extends for connecting with a motor beneath the packer. A set of hydraulically movable slips slidable between retracted and deployed positions are carried on the mandrels on opposite sides of a packing element and a setting cylinder secured to one of said packer mandrels defines a pressure chamber containing a setting piston which is movable from a retracted position to an extended position to compress said packing element and deploy said slips for anchoring said packer in the casing. A control pressure passage extension with one end connecting to said pressure chamber exteriorly of said primary packer mandrel and an opposite end connected to a control pressure line leading to the safety valve provides pressure fluid for setting the slips.

15 Claims, 5 Drawing Figures

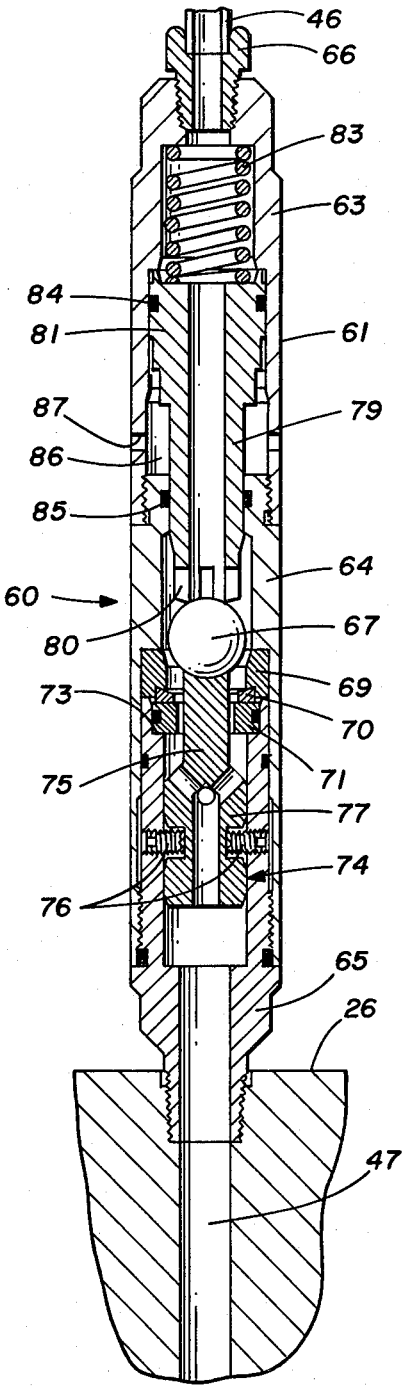
FIG. 3
FIG. 4
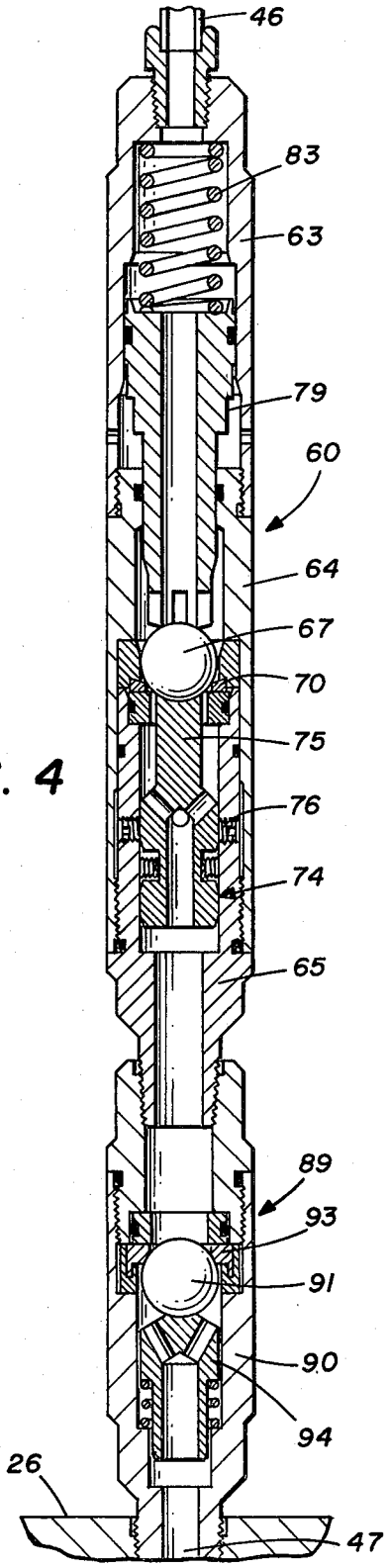

SUBSURFACE SAFETY VALVE SYSTEM WITH HYDRAULIC PACKER

TECHNICAL FIELD

This invention relates to a well production apparatus including multiple subsurface safety valves individually mountable in multiple production passages of a well above a packer anchored to the casing of the well.

BACKGROUND ART

In the prior art device disclosed in U.S. Pat. No. 4,022,273, a bottom hole flow control apparatus includes a cylindrical housing for connection to well tubing. An eccentric main bore in the housing communicates to the well head through the tubing and a bypass bore paralleling the main bore communicates with the annulus between the tubing and the well casing. A packer connected to the lower end of the housing is provided with a set of slips for anchoring the device to casing in the well. When set within the well, packing rings, in the packer serve to seal against the casing blocking fluid flow past the packer. The slips are set by pressurizing a cylinder to shift a slip retainer ring upwardly thereby causing the slips to shift outwardly to engage the casing. Pressurization of the cylinder is accomplished by pressurizing the main bore through the use of a temporary plug positioned below an inlet from the main bore to the pressurizing cylinder. In service use, an electrical conductor passing through the bypass bore provides power to a bottom hole motor for driving a pump to produce fluid from the well. Fluid may be produced both through the main bore and the bypass bore with the main bore typically being used for the production of oil and the bypass bore being used for the production of gas.

In the aforementioned apparatus, a safety valve assembly in the main bore serves both the main bore and the bypass bore in controlling fluid production. A control line communicating with the safety valve assembly normally is pressurized so parts of the valve are held open for flow through both the main and bypass bores. Reduction of pressure in the control line either intentionally or as a result of damage causes the safety valve assembly to close the bores to fluid flow.

Additional well fluid flow control apparatuses are disclosed in the Composite Catalog of Oil Field Equipment and Services 1962–63 at pages 1072 and 1073. For example, safety valves may be employed in a sidepocket mandrel for single-string, dual production where selectively retrievable subsurface safety valves are desired for the fluid produced both through tubing and annulus.

DISCLOSURE OF INVENTION

The present invention contemplates a new and improved well production apparatus including separate safety valves for fluids produced in the tubing and the annulus, but in which the packer slips are set hydraulically by pressurizing through a safety-valve control line. Specifically, the present invention contemplates a control line extension communicating between the control line leading to the safety valves and a pressure chamber in the packer so that when the chamber is pressurized a setting piston therein is extended to urge the slips radially outward to anchor in the well casing.

More particularly, the invention resides in the novel manner of connecting the control line extension to the pressure chamber through a secondary mandrel in the packer while also providing for a power conductor to extend through the same mandrel and at the same time utilize a secondary passage through the secondary mandrel for fluid recovery. Specifically, a setting tube is telescoped into the secondary mandrel with opposite ends of the tube sealed against the mandrel to define an annular passage through which pressure fluid may flow from the control line extension to the pressure chamber for actuating the setting piston.

An additional advantageous feature of the present invention resides in the provision of a cut-off valve between the safety-valves and the pressure chamber to seal against the conduction of pressure through the control line extension after setting pressure is reached in the control line.

Invention still further resides in the provision of a check valve in the control line extension downstream of the cut-off valve for preventing upward pressure fluid flow from beneath the cut-off valve into the control line.

These and other novel features and advantages of the present invention will become more apparent from the following description of the best mode for carrying out the invention when taken in conjunction with the accompanying drawings.

BRIEF DESCRIPTION OF DRAWINGS

FIG. 3 is an enlarged cross-sectional view of a cut-off valve employed in the exemplary system.

FIG. 4 is a view similar to FIG. 3 but showing parts of the cut-off valve in moved positions and the addition of a check-valve downstream of the cut-off valve.

BEST MODE OF CARRYING OUT THE INVENTION

Figure 1:
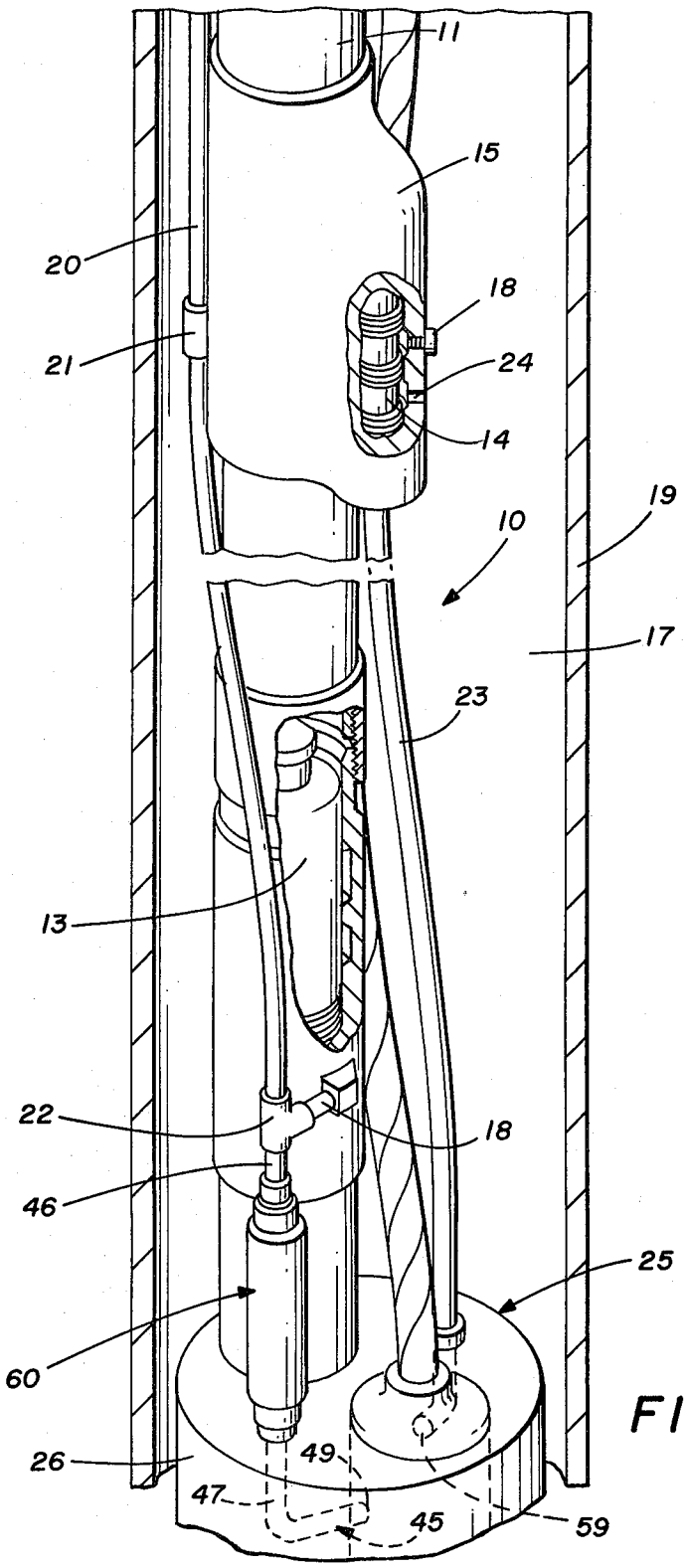
FIG. 1 is a fragmentary perspective view of a subsurface safety valve system utilizing the present invention but with parts of the system broken away for clarity of illustration.

As shown in the drawings for purposes of illustration, the present invention is embodied in a well production apparatus 10 particularly adapted for dual production of well fluids with a single string of well tubing 11. Specifically herein, the apparatus 10 is designed for use within a downhole system including subsurface safety valves 13 and 14 disposed within a sidepocket mandrel 15 as is shown in FIG. 1. The upper end of the sidepocket mandrel is connected to the lower end of well tubing which connects with a well head (not shown). In service use, the safety valves 13 and 14 are held open for producing well fluid both through the tubing and through the annulus 17 defined between the tubing and a casing 19 within the well. Specifically, the primary safety valve 13 provides for the straight-through flow of well fluid to the surface through the tubing 11 while the safety valve 14 connects with a secondary conduit 23 to deliver well fluids through a side port 24 in the sidepocket mandrel 15 to the annulus 17. The interior of the sidepocket mandrel 15 is separated into primary and secondary chambers receiving the two safety valves 13 and 14 with the safety valve 14 being spaced laterally from the safety valve 13. A control line 20 provides control pressure fluid from the surface to keep the valves 13 and 14 open when producing fluid from the well. Within the control line 20 are vertically spaced T-connections 21 and 22 which direct control pressure fluid through branch control lines 18 to the safety valves to hold the valves open.

Connected to the lower end of the sidepocket mandrel 15 is a packer 25 (see FIG. 2) for sealing off the inside of the casing 19 above a formation from which fluids are to be produced. Herein, the packer 25 is of the dual bore type and includes a cylindrical mandrel head 26 having dual parallel bores formed therethrough to define a primary fluid passage 27 and a secondary passage 28. The sidepocket mandrel 15 connects with the mandrel head 26 within the primary bore 27 and a power connector 30 extends through the secondary passage 28 and out the lower end of the packer. The power connector is an electrical cable for supplying the energy to drive a motor and pump (not shown) disposed downhole of the packer.

Figure 2:
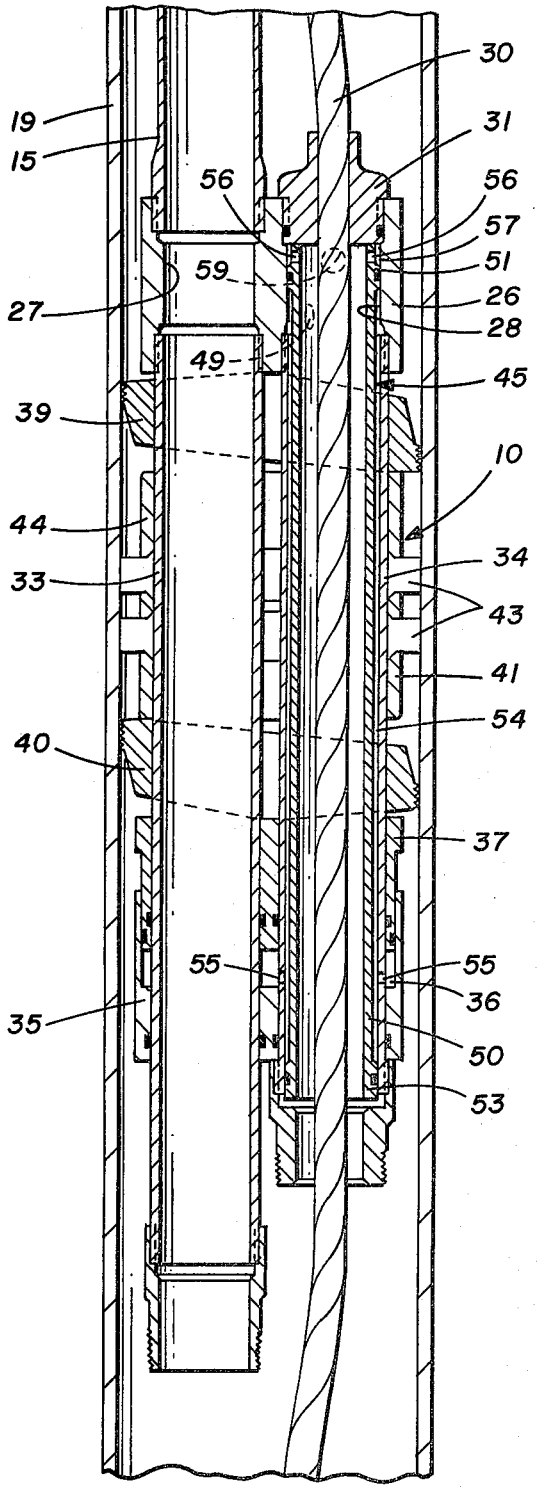
FIG. 2 is a fragmentary cross-sectional view of the well production apparatus embodying the novel features of the present invention.

As shown in FIG. 2, an end plug 31 is sealed on the cable 30 and further is threaded and sealed within the bore 28 to secure the plug to the mandrel head 26. Depending from threaded connections to the mandrel head 26 within the primary and secondary passages 27 and 28 are primary and secondary mandrels 33 and 34, respectively. Spaced vertically below the mandrel head 26 and sealed against each of the primary and secondary mandrels is a setting cylinder 35 which defines a pressure chamber 36. A setting piston 37 fits within the pressure chamber and when shifted upwardly causes upper and lower sets of slips 39 and 40 to engage the interior wall of the casing 19 to anchor the packer in place. In setting the slips, the pressure chamber 36 is pressurized to advance the setting piston 37 from its retracted position into an extended position. As the piston moves it engages the lower set of slips 40 to pivot the lower set of slips relative to both the primary and secondary mandrels 33 and 34 causing teeth on the slips to bite into the interior wall of the casing to anchor the packer in the well. Immediately above the lower set of slips 40 is a lower packer head 41 which is urged against packing elements 43 which, in turn, are urged against an upper packer head 44 that abuts the upper set of slips 39 causing the latter to set against the casing.

In accordance with the primary feature of the present invention, the slips 39 and 40 are set hydraulically by pressurizing the chamber 36 from the safety valve control line 20. For this purpose, a control pressure passage 45 communicates with the pressure chamber 36 from the control line 20 through the mandrel head 26 and the secondary packer mandrel 34 outside of the primary packer mandrel 33. By virtue of this arrangement, the slips may be set hydraulically without encumbering the primary production line or having to make additional trips into the well for installation of the safety valves 13 and 14 because the valves may be installed in the sidepocket mandrel 15 prior to lowering the assembly into the well casing. More importantly perhaps, by setting the slips using control line pressure, potential damage to the downhole pump and motor from articles dropped into the primary fluid passage 27 is avoided by eliminating any need to drop a disposable valve plug into such passage in order to set the slips.

In the present instance, the control pressure passage 45 includes a control line extension 46 leading from the control line 20 to the mandrel head 26. A small bore passage 47 through the mandrel head includes an outlet 49 to the secondary passage 28 which is spaced above the upper end of the secondary mandrel 24 (see FIGS. 1 and 2). Providing a lower end portion of the control pressure passage 45 is a setting tube 50 which is telescoped into the secondary mandrel 34. Enlarged upper and lower ends 51 and 53 of the setting tube are sealed within the mandrel head 26 and the secondary mandrel 34, respectively, so as to define an annular space 54 which serves as the lower end portion of the control pressure passage 45. The small bore outlet 49 communicates with the annular space 54 beneath the enlarged upper end 51 of the setting tube while diametrically spaced inlets 55 are formed through the secondary mandrel 34 adjacent the lower end thereof to communicate the annular space with the pressure chamber 36. Above the seals at the enlarged upper end portion 51 of the setting tube 50, diametrically spaced ports 56 through the setting tube serve to communicate the interior of the setting tube with an annular recess 57. The latter is formed around the upper end of the tube 50 and leads to an outlet passage 59 which extends through the mandrel head 26 and communicates with the secondary conduit 23 for delivering well fluids from the interior of the setting tube to the secondary production line safety valve 14. The lower end of the setting tube 50 of course is opened to the section of the well beneath the packer 25 so that well fluids such as gas may accumulate within the setting tube and flow upwardly through the outlet passage 59 into the secondary conduit 23 and then to the safety valve 14 to be discharged into the tubing annulus 17 to flow to the well head.

Advantageously, with the foregoing described arrangement, a standard dual bore packer such as the one disclosed in the aforementioned U.S. Pat. No. 3,858,648 may be adapted for use in dual production using the safety valves 13 and 14 to control pressure in both the tubing string 11 and the tubing annulus 17 but in a single string system. This is accomplished simply through the addition of the small bore passage 47 and the outlet passage 59 within the mandrel head 26, the use of the power connector cap 31 in sealing the upper end of one of the bores in the mandrel head 26, and the provision of the setting tube 50 telescoped into the secondary mandrel to communicate the interior of the setting tube with the outlet passage 59 through the setting tube ports 56. This arrangement allows for the upper and lower slips 39 and 40 to be set utilizing the pressure in the control line 20 without having to pressurize the primary fluid passage 27 and while the safety valves 13 and 14 are in place so that the valves need not be run separately into the well after setting the packer 25.

In accordance with another important feature of the present invention, a cut-off valve 60 (see FIGS. 1 and 3) is provided in the control line extension 46 to seal against the conduction of pressure applied through the control line 20 to the pressure chamber 36 after setting pressure is reached. Herein, the valve 60 includes a body 61 which for assembly purposes is formed in three sections, an upper section 63, a middle section 64 and a lower section 65. A connector 66 threaded into the upper section secures the control line extension 46 to the valve body 61. The lower section 65 of the body is threaded into the mandrel head 26 so that an axial passage through the body communicates both with the control extension 46 and the small bore passage 47 within the mandrel head 26 when the valve is open. Disposed within the middle section 64 is a valve member 67 which herein, is in the form of a ball adapted to seat within a metallic ring 69 against an elastomeric sealing ring 70 captivated within the middle section 64 by means of a retaining ring 71. The latter is held in place by an upper shoulder 73 formed on the upper end of the lower body section 65. Supporting the valve member 67 upwardly in an open position is a ball support 74 which includes a stem 75 projecting upwardly through the valve seat members 69, 70 and 71 to engage the ball.

In the embodiment of the invention shown in FIGS. 3 and 4, the ball support 74 is held yieldably in place by frangible pins 76 connected between the lower body section 65 and an enlarged lower end portion 77 of the ball support 74. Urged against the opposite side of the ball 67 is a differential piston 79 having an enlarged upper end 81 and a smaller lower end portion 80 castillated for fluid flow engaging the ball. A spring 83 captivated within the upper body section 63 between the enlarged end 81 and the upper end of the section 63 urges the differential piston downwardly against the ball. Upper and lower O-ring seals 84 and 85, respectively define the differential surfaces of the piston and an intermediate chamber 86. The latter includes side ports 87 extending through the upper body section 63 so the intermediate chamber 86 communicates with the tubing annulus.

As shown in FIG. 3, the valve member 67 is supported in an upper position permitting the flow of pressure fluid through the valve body 61 from the control line extension 46 to the small bore passage 47. Herein, the shear value of the frangible pins 76 is related to the desired setting pressure of the upper and lower sets of slips 39 and 40 so that once the desired setting pressure is reached, the pins 76 are sheared owing to the differential forces generated against the piston 79. It will be appreciated that, while the pressure on opposite sides of the piston 79 is approximately the same, the two pressures are acting across different areas as represented by the difference in the areas surrounded by the O-ring seals 84 and 85. In the exemplary form of the present invention, when the pressure for setting the slips reaches approximately 3000 psi above the annulus pressure, the forces acting upon the differential piston 79 are sufficient to cause the pins 76 to shear and shift the valve member 67 downwardly into sealing engagement with the valve seat arrangement 69, 70 and 71. The moved position for the valve member 67 is shown in FIG. 4 and, in this position, the control line 20 is effectively pressure sealed from communication with the pressure chamber 36 for setting the slips. Thus, leakage from the latter chamber or any other place downstream of the valve 60 will not affect the operation of the safety valves 13 and 14 during fluid production from the well.

Figure 5:
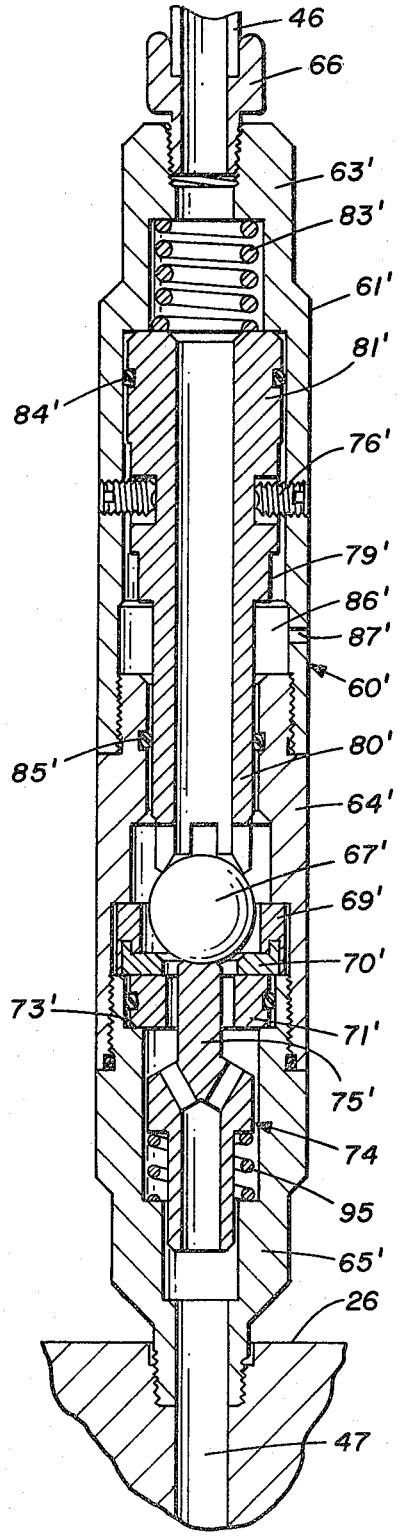
FIG. 5 is an enlarged cross-sectional view of an alternative embodiment of the cut-off valve.

An alternative version of the cut-off valve 60 is shown in FIG. 5 wherein like parts of the valve are identified by the same but primed reference numbers. The primary difference in this second embodiment of the cut-off valve 60 is that the frangible pins 76' are mounted between the differential piston 81' and the upper body section 61'. Additionally, the ball support 75' is urged upwardly against the valve by a small spring 95 captivated within the lower body section 65' of the valve 60'. Otherwise, the valve 60' is of substantially the same construction and functions in generally the same manner as the cut-off valve 60.

Another important feature of the present invention resides in the provision of a reverse flow check valve 89 in the control line extension 46 between the cut-off valve 60 and the small bore passage 47 to prevent the flow of pressure fluid in a reverse direction from the passage 47 to the control line 20. By virtue of this arrangement, the safety valves 13 and 14 are kept from being opened by pressures generated within the well beneath the packer in the event of leakage or loss of any of the seals in the packer between the setting tube 50 and the secondary mandrel 34. Herein, the check valve 89 is of conventional construction including a valve body 90 with a valve member 91 urged against a seat 93 by a spring mounted support 94.

Thus, it is seen from the foregoing that the present invention brings to the art a new and improved well production apparatus 10 wherein the dual bore packer 25 is uniquely adapted for use in conjunction with a single string of tubing but for dual production both through the tubing 11 and the tubing annulus 17, wherein fluid produced through the tubing and the annulus are controlled by the separate safety valves 13 and 14. Advantageously, the packer 25 may be set by hydraulically utilizing control line pressure by virtue of the extension 45 communicating between the control line 20 and the pressure setting chamber 36. A cut-off valve 60 seals off the extension once setting pressure is reached for the slips 39 and 40 and packing elements 43 so as to maintain the integrity of the safety valve system. Additionally the reverse flow check valve 89 prevents fluid pressure leakage in a reverse direction into the control line 20.

The embodiments of the invention in which an exclusive property or privilege is claimed are defined as follows:

1. A well production apparatus for fluid production through safety valve means acting both in well tubing and the annulus between the tubing and casing in a well, said apparatus including a packer with a head connected to the lower end of the tubing and having dual bores extending therethrough for communicating separately with the tubing and the annulus, primary and secondary packer mandrels communicating with said bores and depending from connections with said head, said primary packer mandrel serving as a conduit for directing production fluid to the safety valve means and said secondary packer mandrel serving as a second conduit through which a power conductor extends for connecting with a motor beneath said packer, a set of hydraulically movable slips slidable between retracted and deployed positions, a packing element surrounding said primary and secondary mandrels beneath said head, a setting cylinder secured to one of said packer mandrels and defining a pressure chamber, a setting piston movable on one of said packer mandrels within said pressure chamber from a retracted position to an extended position to compress said packing element and deploy said slips for anchoring said packer in the casing, and a control pressure passage extension with one end connecting to said pressure chamber exteriorly of said primary packer mandrel and an opposite end for connection to a control pressure line leading to the safety valve means, said passage extension serving to deliver pressure fluid to said chamber to set said slips when installing the apparatus in the well.

2. A well production apparatus as defined by claim 1 including a cut-off valve disposed in said passage extension for closing said passage to pressure flow upon reaching a preselected pressure for setting said slips.

3. A well production apparatus as defined by claim 2 wherein said cut-off valve includes a body with a valve member disposed therein and movable from an open position to a closed position, a frangible element supporting said valve member in said open position and shearing when the magnitude of said pressure fluid reaches said preselected pressure to shift said valve member into its closed position.

4. A well production apparatus as defined by claim 2 or 3 including a setting tube telescoped into said secondary packer mandrel and defining a portion of said passage extension communicating with said pressure chamber.

5. A well production apparatus as defined by claim 3 wherein said cut-off valve includes a differential piston disposed within said valve body and engaging said valve member for shifting said member from its open position into its closed position.

6. A well production apparatus as defined by claim 5 wherein said cut-off valve further includes a support engaging said member opposite said differential piston to hold said valve member in its open position, said frangible member being connected between said body and one of said differential piston and said support to keep said piston from moving said valve member before the fluid pressure in said valve reaches said preselected pressure.

7. A well production apparatus as defined by claim 6 wherein said frangible element is connected between said support and said valve body, and a spring urges said valve member toward its closed position to hold said valve member closed after said slips are set and said preselected pressure is reached.

8. A well production apparatus as defined by claim 6 wherein said frangible element is connected between said differential piston and said valve body, said support being slidable within said body from a first position supporting said valve member in its open position and a second position urging said valve member toward its open position from its closed position, a first spring acting between said support and said body and urging said support toward its first position, a second spring acting between said differential piston and said body and urging said piston to move said valve member into its closed position with a force greater than the force of said first spring.

9. A well production apparatus as defined by claim 1 or 2 including a reverse flow check valve disposed in said passage extension.

10. A well production apparatus as defined by claim 1 including a setting tube telescoped into said secondary packer mandrel and defining a portion of said passage extension communicating with said pressure chamber.

11. A well production apparatus for fluid production through both a single string of tubing and an annulus between the tubing and casing in a well, said apparatus including a sidepocket mandrel having an upper end for connecting to the tubing, primary and secondary chambers within said mandrel for receiving therein first and second pressure opened safety valves, a packer with a head connected to the lower end of said sidepocket mandrel and having dual bores extending therethrough, primary and secondary packer mandrels communicating with said primary and secondary chambers, respectively, and depending from said head from connections within said bores, a power conductor extending from outside of said sidepocket mandrel and through said secondary mandrel for connecting with a motor beneath said packer, a set of hydraulically movable slips slidable between retracted and deployed positions, a packing element surrounding said primary and secondary mandrels beneath said head, a setting cylinder secured to one of said packer mandrels and defining a pressure chamber, a setting piston movable on one of said packer mandrels within said pressure chamber from a retracted position to an extended position to compress said packing element and deploy said slips for anchoring said packer in the casing, a control pressure line connecting to said primary and said secondary chambers for pressurizing said first and second safety valves to open to direct production fluid from said primary and secondary mandrels, through the tubing and the annulus, respectively, and to the well head during in-service-use of said apparatus, a setting tube telescoped into said secondary mandrel with opposite ends of said tube being sealed therewith and defining a setting pressure passage therebetween, an inlet port through said secondary mandrel communicating with said passage, an outlet port through said secondary mandrel communicating between said pressure chamber and said passage, and a control line extension connecting between said control line and said inlet port exteriorly of said primary packer mandrel for pressurizing said chamber to set said slips when installing the apparatus in the well.

12. A well production apparatus for fluid production through both a single string of tubing and an annulus between the tubing and casing in a well, said apparatus including a sidepocket mandrel having an upper end for connecting to the tubing, primary and secondary chambers within said mandrel for receiving therein first and second pressure opened safety valves, a packer with a head connected to the lower end of said sidepocket mandrel and having dual bores extending therethrough, primary and secondary packer mandrels communicating with said primary and secondary chambers, respectively, and depending from said head from connections within said bores, a power conductor extending from outside of said sidepocket mandrel and through said secondary mandrel for connecting with a motor beneath said packer, a set of hydraulically movable slips slidable between retracted and deployed positions, a packing element surrounding said primary and secondary mandrels beneath said head, a setting cylinder secured to one of said packer mandrels and defining a pressure chamber, a setting piston movable on one of said packer mandrels within said pressure chamber from a retracted position to an extended position to compress said packing element and deploy said slips for anchoring said packer in the casing, a control pressure line connecting to said primary and said secondary chambers for pressurizing said first and second safety valves to open to direct production fluid from said primary and secondary mandrels, through the tubing and the annulus, respectively, and to the well head during in-service-use of said apparatus, a control line extension connecting between said control line and said inlet port exteriorly of said primary packer mandrel for pressurizing said chamber to set said slips when installing the apparatus in the well, and a cut-off valve disposed in said control line extension for closing off said extension to fluid flow and limiting the magnitude of the pressure in the pressure fluid flowing therethrough to a preselected value for setting said slips.

13. A well production apparatus as defined by claim 12 including a reverse flow check valve disposed in said passage extension.

14. A well production apparatus as defined by claim 12 or 13 wherein said cut-off valve includes a body with a valve member disposed therein and movable from an open position to a closed position, a frangible element supporting said valve member in said open position and shearing when the magnitude of said pressure fluid reaches said preselected pressure to shift said valve member into its closed position.

15. A well production apparatus as defined by claim 14 wherein said cut-off valve includes a differential piston disposed within said valve body and engaging said valve member for shifting said member from its open position into its closed position.

* * * * *